US006785397B2

(12) United States Patent
Arnstein

(10) Patent No.: US 6,785,397 B2
(45) Date of Patent: Aug. 31, 2004

(54) ELECTRO-ACOUSTIC CONVERTER

(76) Inventor: Barry Arnstein, 3 Della Torre Crescent, Ivanhoe (AU), 3079

( * ) Notice: Subject to any disclaimer, the term of this patent is extended or adjusted under 35 U.S.C. 154(b) by 31 days.

(21) Appl. No.: 10/079,117

(22) Filed: Feb. 19, 2002

(65) Prior Publication Data

US 2002/0146144 A1 Oct. 10, 2002

(30) Foreign Application Priority Data

Feb. 16, 2001 (AU) ..... PR3179

(51) Int. Cl.[7] ..... H04R 11/02

(52) U.S. Cl. ..... 381/423; 381/401; 381/430; 181/173; 181/165

(58) Field of Search ..... 381/186, 190, 381/191, 405, 423, 430, 432; 310/324, 334

(56) References Cited

U.S. PATENT DOCUMENTS

| | | | | | |
|---|---|---|---|---|---|
| 638,207 A | | 11/1899 | Rice | | |
| 3,978,353 A | * | 8/1976 | Kinoshita | 310/317 | |
| 4,139,733 A | * | 2/1979 | Falkenberg | 381/96 | |
| 4,321,434 A | | 3/1982 | Irie | 179/181 R | |
| 4,379,213 A | | 4/1983 | Lehnhardt | 179/115.5 R | |
| 4,473,721 A | | 9/1984 | Klein | 179/110 A | |
| 4,989,254 A | | 1/1991 | Amalaha | 381/202 | |
| 5,014,321 A | * | 5/1991 | Klein | 381/111 | |
| 5,103,483 A | | 4/1992 | Klein | 381/190 | |

FOREIGN PATENT DOCUMENTS

| | | | | |
|---|---|---|---|---|
| JP | 02-309799 | * 12/1990 | ..... | H04R/1/44 |
| JP | 63042298 | * 2/1998 | ..... | H04R/1/44 |

* cited by examiner

*Primary Examiner*—Curtis Kuntz
*Assistant Examiner*—Brian Ensey
(74) *Attorney, Agent, or Firm*—David A. Farah; Sheldon & Mak PC

(57) ABSTRACT

An electro-acoustic converter, comprising a barrel shaped diaphragm (2) formed about a longitudinal axis (3) and comprising first and second annular opposed ends (4, 5), and a first electrically driven vibration generator (6-11) for inducing a vibrational movement in the first annular end in the direction of the longitudinal axis.

4 Claims, 5 Drawing Sheets

ELECTRO-ACOUSTIC CONVERTER

CROSS-REFERENCE TO RELATED APPLICATION

This application claims benefit of Australian Patent Application No. PR3 179, filed Feb. 16, 2001, and titled "Electro-Acoustic Converter," the contents of which are incorporated by reference herein in its entirety.

BACKGROUND

The present invention relates generally to loud speakers and like devices for converting variations of electrical energy into corresponding variations of acoustic energy, such as, sound. The present invention is suitable for use both in specialized loud speakers forming part of hi-fidelity sound reproduction systems, and as a loud speaker for general applications in televisions, radio and other consumer markets, and it will be convenient to describe the invention in relation to such an exemplary, non limiting applications.

The basic operation of loud speakers and like electro-acoustic converters is well known. In such devices, an electrically driven vibration inducing member, such as a moving coil or piezo-electric crystal, is attached to one end of a diaphragm. Variations in the electrical signal applied to the vibration inducing member are converted into mechanical vibrations which are amplified by the diaphragm and result in the production of sound waves in the air.

In dynamic or moving-coil loud speakers the vibration inducing member includes a moving coil, attached to the diaphragm, which oscillates in an annular cavity of either a specially shaped permanent magnet or an electro magnet. The efficiency of such a loud speaker in converting electrical energy into sound energy is governed by three main factors, namely, the product of the active links of the moving coil and the magnetic field strength, the effective area of the diaphragm, and the total moving mass of the diaphragm, moving coil assembly and the acoustic air load. An increase in the first two parameters, either singly or together will result in an increase in the efficiency of the loud speaker. However, an increase in the mass will result in a reduction in the loud speaker efficiency.

All loud speakers are carefully designed in an attempt to optimize these parameters, based on the specific market the loud speaker is intended for and the manufacturing cost of the loud speaker. However, difficulties arise in the optimization of these parameter. For example, whilst an increase in the area of the diaphragm can often provide the most effective loud speaker gain improvement, high frequency beaming and roll off is found to occur once the area of conventional dome type diaphragms is increased beyond a certain point.

SUMMARY

An object of the present invention is to ameliorate or overcome one or more disadvantages of known electro-acoustic converters.

With this in mind, the present invention provides an electro-acoustic converter, comprising a barrel shaped diaphragm formed about a longitudinal axis and comprising first and second annular opposed ends, and a first electrically driven vibration generator for inducing a vibrational movement in the first annular end in the direction of the longitudinal axis.

An electro-acoustic converter having these features enables a greater area of diaphragm to be used in the reproduction of sound waves than do existing electro-acoustic converters, without the high frequency limitations of such standard converters.

Preferably, the electro-acoustic converter comprises a second electrically driven vibration generator for inducing a vibrational movement in the second annular end of the diaphragm in the direction of the longitudinal axis.

The first and second vibration generators may act simultaneously to the first and second annular ends to either compress or stretch the diaphragm.

One or both the first and second vibration generators may be a moving coil drive system. Such a drive system may comprise a vibration coil attached around either or both of the first and second annular ends of the diaphragm.

Alternatively, one or both of the first and second vibration generators may be a crystal drive system. Such a system may comprise a piezo-electric crystal attached to one or both of the first and second annular ends.

A series of electro-acoustic converters according to the present invention, each adapted for the optimal reproduction of a preselected frequency range, may be mounted in a single loud speaker arrangement. For example, the electro-acoustic converters may be arranged in a stack, or in end to end relation. Such an arrangement has been found to optimize the omni-directional sound dispersal of such a loud speaker arrangement.

FIGURES

These and other features, aspects and advantages of the present invention will become better understood with regard to the following description, appended claims, and accompanying figures where:

DESCRIPTION

Figure 1:
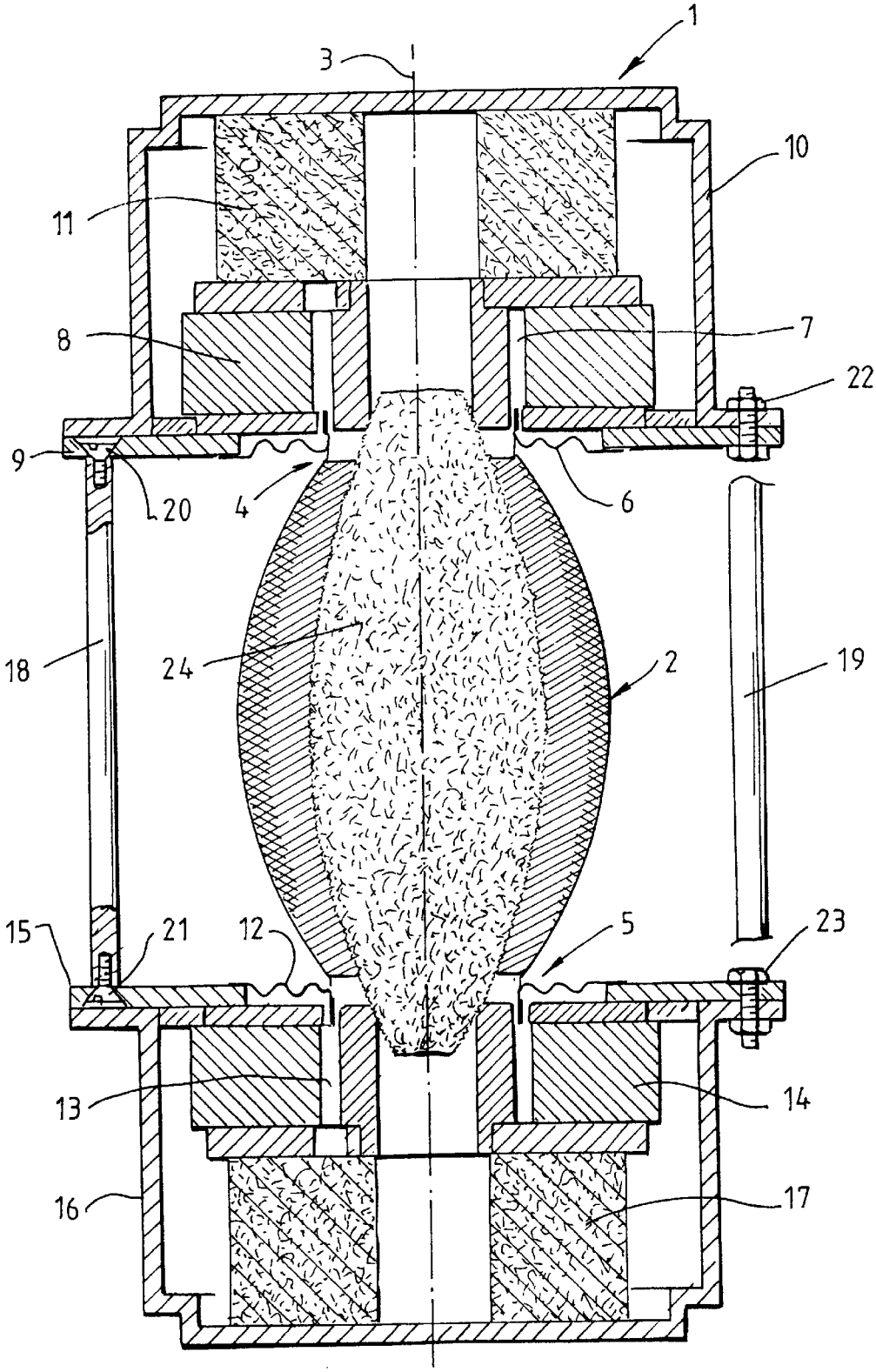
FIG. 1 is a cross sectional view of one embodiment of an electro-acoustic converter according to the present invention.
Figure 2:
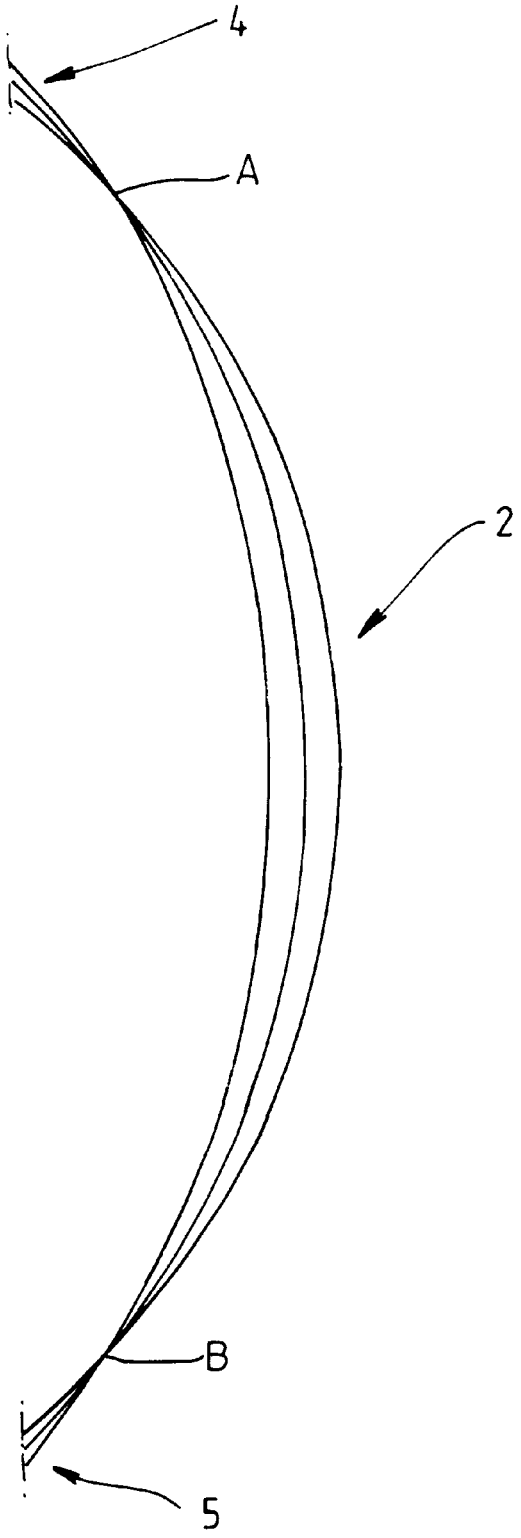
FIG. 2 is a schematic diagram illustrating the movement of the diaphragm of the electro-acoustic converter of FIG. 1.

The following description refers in more detail to the various features of the electro-acoustic converter of the present invention. To facilitate an understanding of the invention, reference is made in the description to the accompanying drawings where the electro-acoustic converter is illustrated in a preferred embodiment. It is to be understood that the electro-acoustic converter of the present invention is not limited to the preferred embodiment illustrated in the drawings.

Referring now to FIG. 1, there is shown generally an electro-acoustic converter 1 comprising a diaphragm 2 having a barrel shaped body formed about a longitudinal axis 3 between a first annular end 4 and a second opposed annular end 5. As can be seen from this Figure, the barrel shaped diaphragm 2 is curved so that the diameter of the diaphragm at the two opposed annular ends 4, 5 is less than the diameter of the diaphragm at a point intermediate these two ends. Typically, the diaphragm may be formed from a textile or like material, but other materials known to persons skilled in the sound reproduction field may also be used.

In this embodiment, a first moving coil 6 is attached around the first annular end 4 of the diaphragm 2. The moving coil 6 is located within the electro-acoustic converter 1 in an annular cavity 7 within a permanent upper magnet assembly 8. Electrical oscillations in the current flowing through the moving coil 6 in the presence of the magnet field generated by the permanent magnet 8 cause the moving coil 6, and the first annular end 4 of the diaphragm 2 to oscillate in the annular cavity 7.

The permanent magnet 8 is mounted to a circular upper mounting plate 9 and covered by an upper casing 10. An upper acoustic absorbent ring 11 is mounted between the upper casing 10 and the permanent magnet 8.

In other embodiments of the invention, the permanent magnet may be replaced by an electro magnet. Alternatively, the moving coil 6 and permanent magnet 8 may be replaced by a crystal drive system, in which the first end 4 of the diaphragm is attached to a piezo-electric or like crystal which undergoes periodic variations in thickness (oscillations) in the presence of an alternating voltage. In such an arrangement, these oscillations are transmitted to the diaphragm 2 both the attachment of the first end 4 to the crystal. It is to be appreciated that these arrangements represent only three possible embodiments of electrically driven vibration generators which induce a vibrational movement in the first annular end 4 of the diaphragm 2 in the direction of the longitudinal axis 3, and that other arrangements may be envisaged by a skilled person in the field of loud speaker design.

Similarly, the electro-acoustic converter 1 may further comprise a second moving coil 12 attached around the second annular end 5 of the diaphragm 2. The moving coil 12 may be located within an annular cavity 13 of a permanent magnet 14. Once again, electrical oscillations in the current flowing through the moving coil 12 in the presence of the magnetic field generated by the permanent magnet 14 cause the moving coil, and the second end 5 of the diaphragm 2 to which it is attached, to vibrate in the direction of the longitudinal axis 3. The permanent magnet 14 is mounted to a circular lower mounting plate 15 and housed within a lower casing 16. A lower acoustic absorbent ring 17 may be provided between the permanent magnet 14 and the lower casing 16.

In other embodiments, the permanent magnet 14 may be replaced by a electro magnet. Alternatively, the moving coil 12 and the permanent magnet 14 may be replaced by a crystal drive system as described previously.

Spacer rods, such as those referenced 18 and 19 may be provided to maintain a fixed relation between the upper and lower mounting plates, and the permanent magnets 8 and 14 mounted thereto. Spacer rod screws, such as those referenced 20 and 21, may be provided to affix the spacer rods 18, 19 to the mounting plates 9, 15. Similarly, casing bolts, such as those referenced 22 and 23 may be provided to affix the upper and lower casings 10 and 16 to the upper and lower mounting plates 9 and 15.

At least part of the interior of the diaphragm 2 may be filled with sound damping material 24. The central pole of one or both of the permanent magnets 8, 14 may be hollow, and the damping material 24, may project into that hollow.

Figure 3:
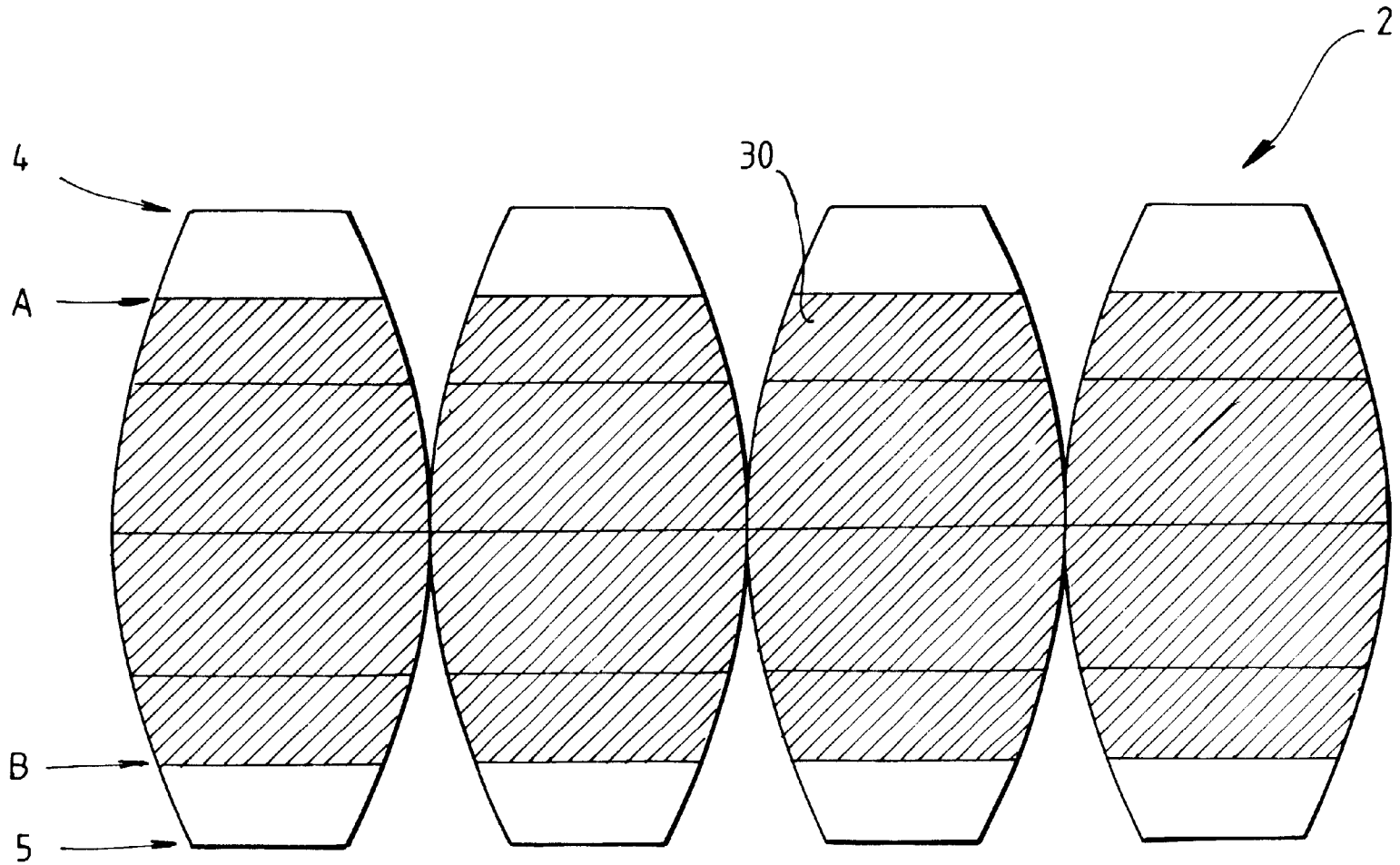
FIG. 3 is a schematic diagram illustrating the area of the diaphragm of the electro-acoustic converter of FIG. 1.

The action of the two moving coils 6 and 12 in alternately compressing and stretching the flexible diaphragm 2 of an appropriate barrel shaped profile causes the vibrational movement of the diaphragm 2 in the direction of the longitudinal axis 3 to be transformed into a corresponding vibrational movement in the central portion of the diaphragm 2 in a direction perpendicular to the longitudinal axis 3, and the radiation of sound waves from the diaphragm 2 in that perpendicular direction. FIG. 3 shows a section of the surface of the diaphragm 2. In this embodiment, the diaphragm 2 has a 5.67 centimeter radius curvature, and the separation between the first annular end 4 and the second annular end 5 is 8.0 centimeters. Intermediate the two annular ends 4, 5, the diameter of the diaphragm 2 is 5.6 centimeters. Simultaneous compressional stretching of the diaphragm 2 at the first and second annular ends 4, 5 by one millimeter causes a corresponding two millimeter movement of the diaphragm 2 at this intermediate position.

Figure 5:
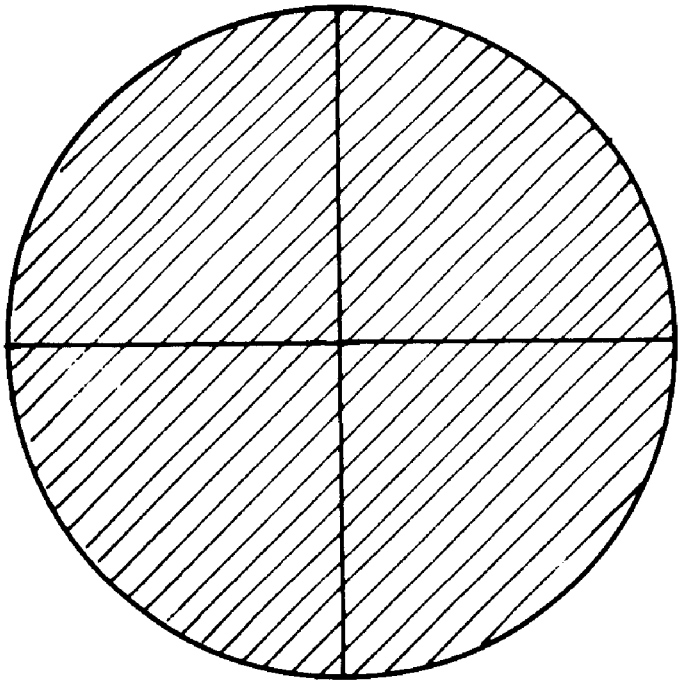
FIG. 5 is a schematic diagram illustrating the effective area of the diaphragm of a conventional dome style speaker.

As can be seen in FIG. 3, during the vibrational movement of the diaphragm 2, nodes are established at points A and B, respectively proximate the first annular end 4 and the second annular end 5. That portion of the diaphragm 2 between the nodes A and B effectively contributes to the sound production of the diaphragm 2. In a diaphragm 2 having the above described dimensions, around seventy percent of the diaphragm is contributing to the sound output. This effective diaphragm area is shown by the shaded area referenced 30 in FIG. 3. For the purposed of comparison, a mid range loud speaker of a conventional dome style, comprising a two inch dome of an actual diameter of 54 millimeters and a linear voice coil excursion of two millimeters will be considered. The effective area of such a two inch dome is illustrated in FIG. 5. Such a dome is typically intended for a frequency range of 800 Hz to 4 kHz the corresponding mid range loud speaker shown in FIG. 1, by contrast, has an effective diaphragm area some four times that of the dome driver. If the same voice coil excursion as for the dome loud speaker, namely 2 millimeters, were to be used, the average displacement of the barrel shaped diaphragm will also be close to two millimeters. This is four time the volume displacement of the dome style loud speaker. Since it is possible to achieve sound pressure levels (peak) of the order of 120 decibels with a two inch dome, it may no longer be necessary to achieve higher sound pressure levels in practice. For example, if the design goal is around 120 decibels, then by reducing the excursion of the voice coils to 0.5 millimeters, the efficiency of the magnet assembly can be raised to achieve the required sound pressure level.

Figure 4:
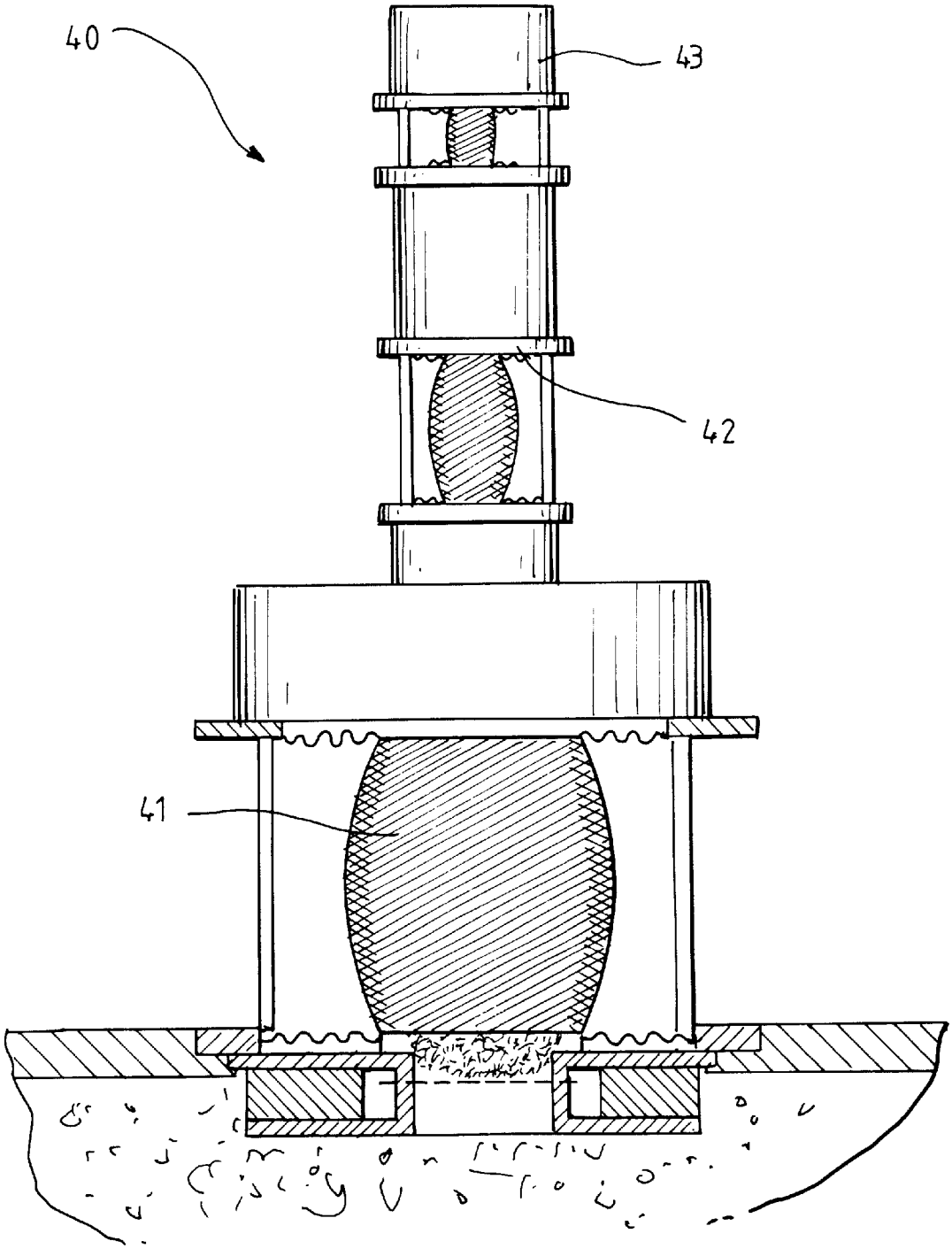
FIG. 4 is a cross sectional diagram showing one embodiment of a loud speaker arrangement comprising three electro-acoustic converters of the type shown in FIG. 1.

The electro-acoustic converter shown in FIG. 1 can be implemented as a series of electro-acoustic converters mounted in a single loud speaker arrangement. Such an arrangement 40 is illustrated in FIG. 4. The loud speaker arrangement 40 comprises a base electro-acoustic converter 41, a mid range electro-acoustic converter 42 and a trebly electro-acoustic converter 43. Each of the electro-acoustic converters 41 to 43 are mounted in the loud speaker arrangement 40 in an end to end or stacked relation by the mounting together of adjacent casings. The dimensions and parameters of each of the electro-acoustic converters 41 to 43 are selected so as to optimize the sound reproduction characteristics respectively in the base, mid range and treble frequency range. Stacking of the electro-acoustic converter 41 to 43, as shown in FIG. 4, assists in providing an omni directional sound dispersal. For uses where a more directions sound field coverage is required, such as public address and cinema applications, horn structures or reflector canopies (not shown) may be easily designed and adapted for use with the loud speaker arrangement 40 by a skilled person in the field of loud speaker design.

Although the present invention has been discussed in considerable detail with reference to certain preferred embodiments, other embodiments are possible. Therefore, the scope of the appended claims should not be limited to the description of preferred embodiments contained in this disclosure.

What is claimed is:

1. An electro-acoustic converter, comprising:

a barrel shaped diaphragm formed about a longitudinal axis and comprising first and second annular opposed ends;

a first moving coil drive system for inducing a vibrational movement in the first annular end in the direction of the longitudinal axis; and a second moving coil drive system for inducing a vibrational movement in the second annual end of the diaphragm in the direction of the longitudinal axis, wherein the first and second moving coil systems act simultaneously to the first and second annular ends to either compress or stretch the diaphragm.

2. An electro-acoustic converter according to claim 1, where the first moving coil drive system comprises a first vibration coil attached around the first annular end of the diaphragm.

3. An electro-acoustic converter according to claim 1, where the second moving coil drive system comprises a vibration coil attached around the second annular end of the diaphragm.

4. A loud speaker arrangement comprising a plurality of electro-acoustic converters according to claim 1, where the electro-acoustic converters are mounted in the loud speaker arrangement in an end to end relation.

* * * * *